US005269494A

United States Patent [19]

Pittman et al.

[11] Patent Number: 5,269,494

[45] Date of Patent: Dec. 14, 1993

[54] DECK AND SOFFIT BOARD CAMMING OR PUSHING DEVICE FOR PUSHING BOARDS TOGETHER

[75] Inventors: Louis B. Pittman; Harvard K. Riddle, both of Greenville; Ralph R. Barnett, Greer, all of S.C.

[73] Assignee: Midas Tool Company, Greenville, S.C.

[21] Appl. No.: 48,009

[22] Filed: Apr. 19, 1993

[51] Int. Cl.[5] ..... B66F 3/00

[52] U.S. Cl. ..... 254/17

[58] Field of Search ..... 254/15, 16, 17

[56] References Cited

U.S. PATENT DOCUMENTS

| | | |
|---|---|---|
| 77,610 | 5/1868 | Hall . |
| 389,919 | 9/1888 | Boettner . |
| 832,516 | 10/1906 | Williams . |
| 1,665,430 | 4/1928 | Arzt . |
| 2,864,581 | 12/1958 | Harrison . |
| 4,620,691 | 11/1986 | Waters . |
| 4,821,784 | 4/1989 | Cone . |
| 5,139,231 | 8/1992 | Temple . |

FOREIGN PATENT DOCUMENTS 932305 7/1963 United Kingdom .

*Primary Examiner*—Robert C. Watson

*Attorney, Agent, or Firm*—Henry S. Jaudon; Cort Flint

[57] ABSTRACT

The camming device weighs no more than four pounds for forcing an unsecured member into contact with a secured member where the unsecured member may be secured with a support member. The camming device includes a support plate which carries a locking arrangement. The locking arrangement includes a pair of locking lugs and a locking lever. The device also includes a camming member having camming surfaces and an operating lever having a handle. The camming member is pivotally secured with the support plate in an eccentric fashion. In operation the support member is positioned adjacent an unsecured member and on one of the support members. The lugs are arranged to extend along opposite sides of the support member. The locking lever is rotated in one direction which locks the support plate with the support member. Now the operating lever is rotated to move the camming member against the unsecured member which presses it into position adjacent the secured member. Here it is secured in position with the support member.

16 Claims, 3 Drawing Sheets

DECK AND SOFFIT BOARD CAMMING OR PUSHING DEVICE FOR PUSHING BOARDS TOGETHER

BACKGROUND OF THE INVENTION

The instant invention is directed to a camming or pushing device which is adapted to push unsecured boards such as flooring boards, into contact along their entire length with boards already secured in position. The device is not only intended to provide a smooth and continuous abutment of adjacent boards which are straight, but it is also intended to press out warps or bends in boards which are not straight so that they may be secured in a straight condition.

Due to the present day curing processes most boards or planks today are not straight. This creates a situation when building floors or in some cases soffits or overhangs where it is extremely difficult to produce a satisfactory product. To select only straight boards for use is to too time consuming and is sometimes not possible. To allow gaps or separations between adjacent boards is not satisfactory.

Numerous devices have been employs over the years to pres the next to be secured board into continuous contact with the secured board where if may be secured. For example, U.S. Pat. No. 77,610 discloses a floor clamp in which a cam is secured to one end of a pivoted lever which is adapted to press boards. The lever is pivoted with a mount which secures with a joist. The cam is mounted with lever on a selected side of the pivot depending on the direction of use. Another known arrangement is shown in U.S. Pat. No. 389,919 where a ratcheting arrangement is used to press the boards into position. More modern attempts at providing satisfactory board pressing means are shown in U.S. Pat. Nos. 4,821,784 and 5,139,231. Each of these patents use lever arrangements which are pivoted to support members which are mounted with the joist. Both of these arrangements utilize mounting members which penetrate the support joist.

It is an object of the instant invention to provide a board camming or pushing device which is easy to use.

Another object of the invention is to provide a board camming or pushing device which is operative in either direction without adjustment.

Another object of the invention is to provide a mounting member for a board camming or pushing device which is easily located with a support board or joist and easily locked in position.

Another object of the invention is to provide a board camming or pushing device which is light weight and small in size.

Another object of the invention is to provide a board camming or pushing device in which adjustments are not necessary prior to actuating the camming element.

SUMMARY OF THE INVENTION

The instant invention is directed to a board camming or pushing device adopted to press unsecured boards into contact with boards already secured to support joist along their entire length. The camming device includes a mounting plate having an outer edge and an upper and lower surface. A pair of spaced lugs extend downwardly from the lower surface of the mounting plate and are spaced sufficiently to receive individually a support joist therebetween. The mounting plate is provided with a first aperture and a second aperture.

The first and second apertures are arranged in diametric opposed relationship and are formed to be substantially adjacent the outer edge of the mounting plate. A locking lever is secured with the camming plate via the second aperture and is arranged to extend vertically from the upper surface.

The camming device also includes a camming plate having an outer edge and an operating lever. There is an aperture formed in the camming plate substantially adjacent its outer edge and oppositely of the operating lever. A securing pin pivotly connects the mounting plate with the camming plate in an eccentric manner. The securing pin passes through the first aperture of the mounting plate and the aperture of the camming plate.

In operation the mounting plate rests on one of the support joist in position adjacent a board to be pressed. The locking lever is rotated to lock the support plate with the joist by camming the lugs against opposite sides of thereof. The operating lever is now shifted to drive the outer camming surface of the camming plate against the unsecured board which pushes it into contact with the secured board. In this position the unsecured board is secured with the joist.

The lugs are formed with at least two inner faces arranged at 45° angles to form facing edges. The inner faces may have a roughened texture.

The support plate and the camming plate may have a circular outer surface.

The operating lever, which is movable in either direction, is moved in the same direction as the direction in which the locking lever has been moved. The operating lever, which is removably attached to the camming plate, includes a vertically extending handle.

The camming device is preferably made of cast aluminum and the lugs are formed integral with said support plate.

The construction designed to carry out the invention will hereinafter be described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 1:
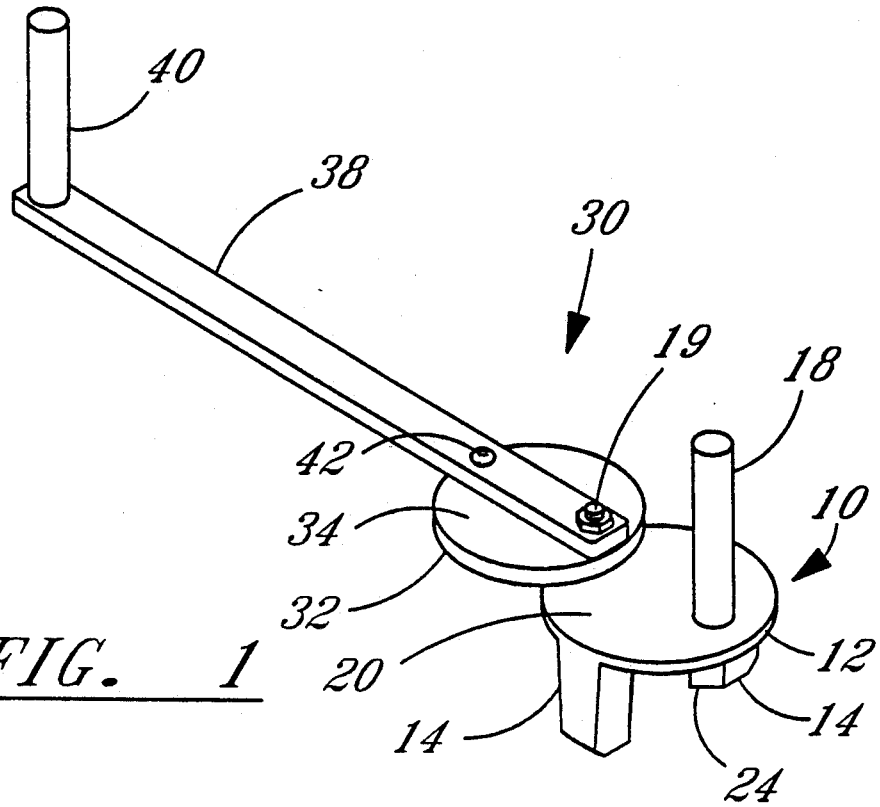
FIG. 1 is a top perspective view of the board camming or pushing device of the invention.
Figure 2:
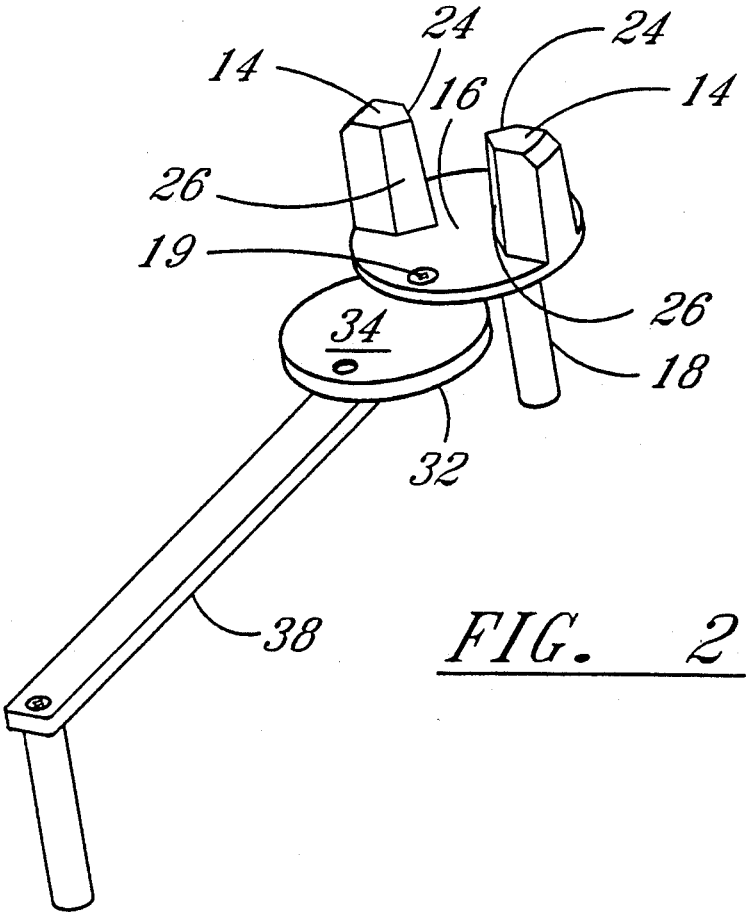
FIG. 2 is a bottom perspective view of the device of the invention.
Figure 3:
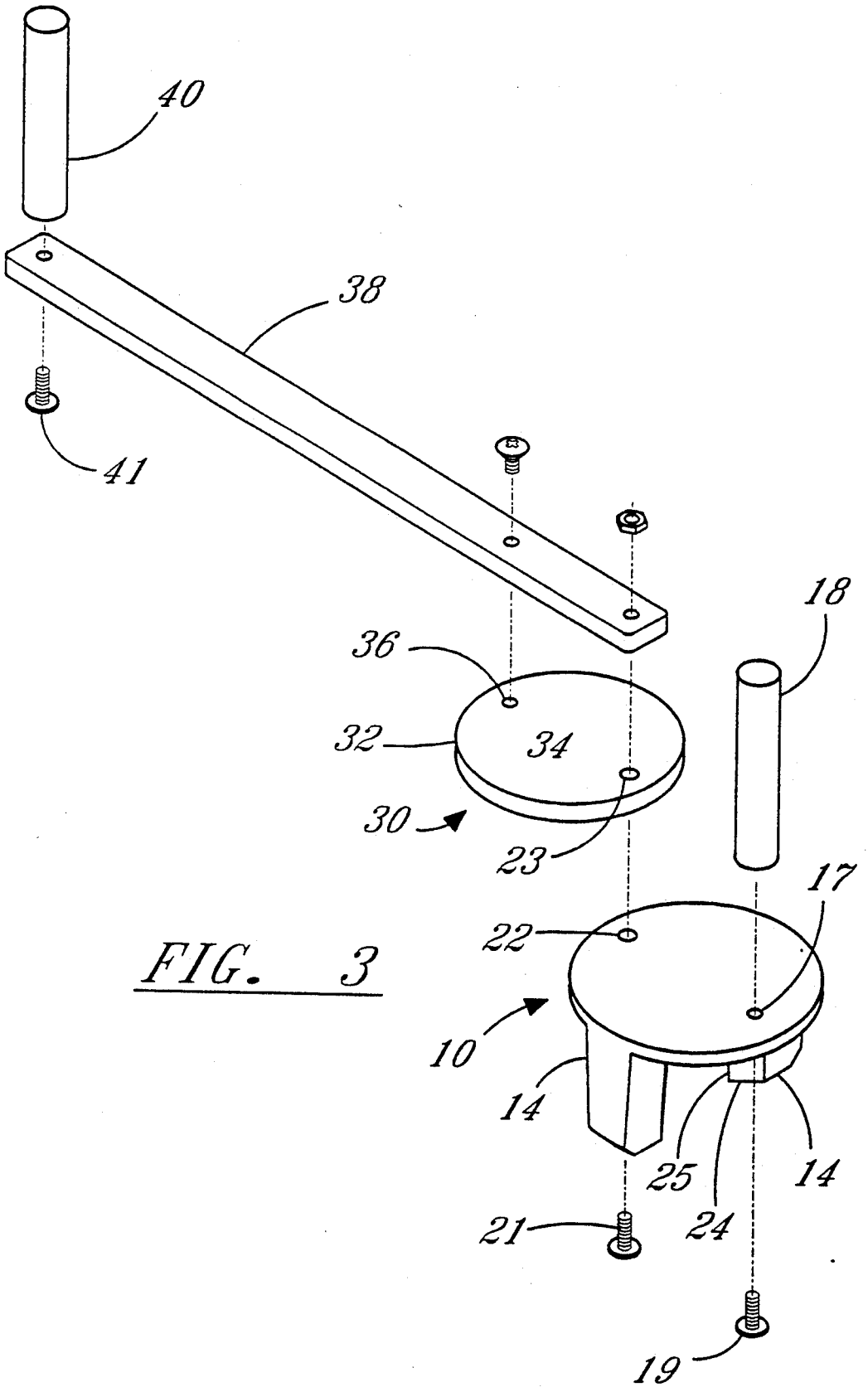
FIG. 3 is an exploded perspective view of the device of the invention.

The board camming or pushing device according to the invention can best be seen in FIGS. 2 and 3 of the drawings. The camming device includes a support plate 10 which is shaped as a disk having an outer circumference 12. A pair of lugs 14 are formed with support plate or disk 10 to extend downwardly from lower face 16. A locking lever 18 is secured adjacent the periphery of upper face 20 by bolt 19 which passes through aperture 17. Locking lever 18 is arranged intermediate of lugs 14. Diametrically opposed locking lever 18 an aperture 22 is formed in support plate 10. This aperture is designed to receive a mounting pin 21 which pivotally secures support plate 10 with camming plate 30 to be hereinafter described.

Support plate 10 is constructed to have a diameter of between 3" and 5" with 4.5" being preferred. Lugs 14 are between 1.5" and 3" in length with 2" being preferred. The lugs are circumferentially sized so that a space of approximately 1.75" is provided between the opposing edges of the innermost faces 24 and 26. The pair of opposed inner faces 24 and 26 are arranged relative to each other at 45° angles so as to form an edge 25 at their point of intersection. The exterior surface of inner faces 24 and 26 may be roughened or serrated, however, such configuration is not necessary.

A camming or pushing plate 30 is pivotally secured with support plate 10 via aperture 22, 23 and securing pin 19. Camming plate 30 is secured in an eccentric manner with support plate 10 as the securing means 19 is located substantially adjacent outer edges 12 and 32. Camming plate 30 has a diameter of approximately 4" which is slightly smaller than the diameter support plate 10. An operating 38 lever is secured to upper surface 34 of camming plate 30 by pin 19 at one end and also by a second pin 42. The opposite end of operating 38 carries a vertically extending handle 40.

Ideally, operating lever 30 is approximately 12" long, support plate 10 has a 4.5" diameter and camming plate 30 is 4" in diameter. Of course, these measurements may vary without departing from the scope of the invention.

Figure 4:
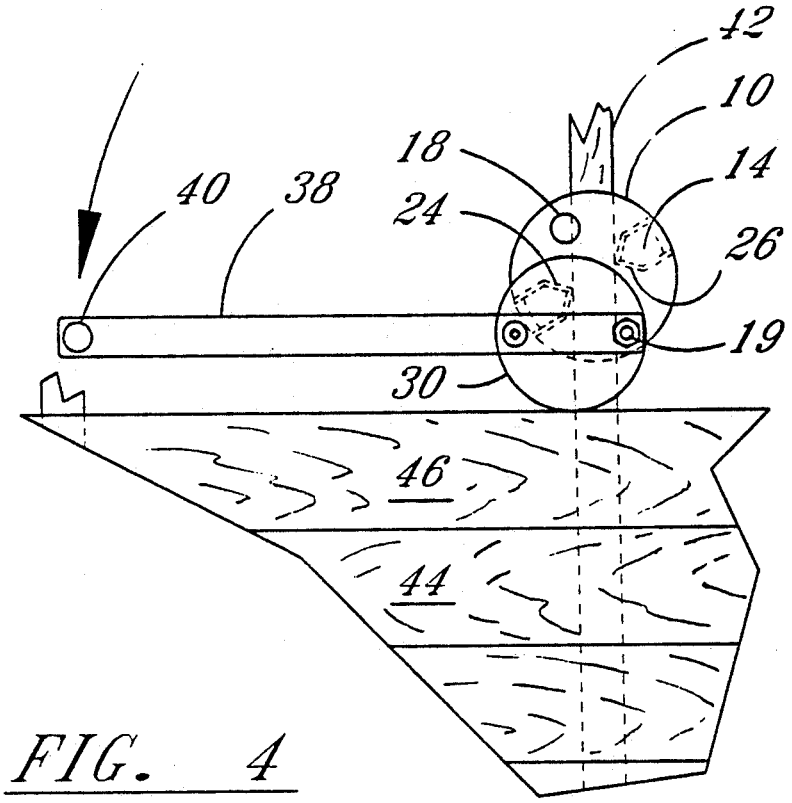
FIG. 4 is a top view showing the device operating with a counter clockwise motion to cam a board into position.
Figure 5:
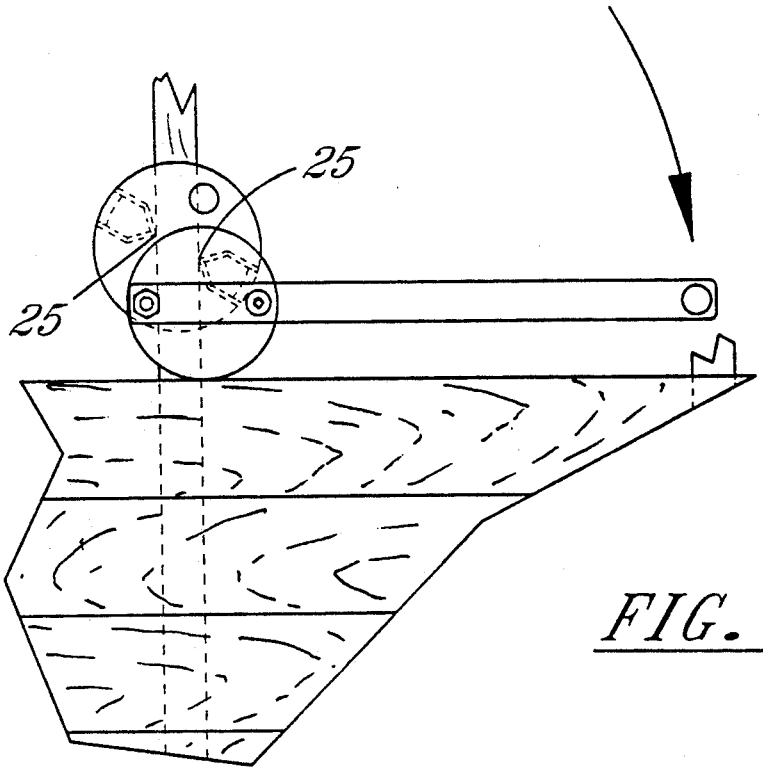
FIG. 5 is a top view showing the device operating with a clockwise motion to cam a board into position.

Turning now to FIG. 4, the camming device is seen positioned adjacent a board being pushed into position. As shown support plate 10 rest on the upper surface of a floor joist 42 with lugs 14 extending along each side thereof. The camming device is positioned so that camming plate 30 is in contact with the outer edge of an unsecured board 46. In this position the locking lever is actuated counter clockwise or in the direction of the arrow to lock lugs 14 and particularly edges 25 into engagement with the opposite sides of joist 42. As can be seen in FIGS. 4 and 5, a single face 24 along with an opposed face 26 and edges 25 engage with the joist.

With support plate 10 secured in position, operating lever 38 is actuated counter clockwise as indicated by the arrow to force edge 32 of camming plate 30 against board 46. Due to the eccentrically located pivot pin 19, camming plate 30 presses board 46 into contact with board 44 which is already secured with joist 42.

FIG. 5 shows the same operation in mirror image. Here locking lever 18 has been moved clockwise to lock support plate 10 with joist 42. Operating lever 38 is also moved clockwise to force outer surface 32 of camming plate 30 against board 46 in the manner previously described.

The ability of the camming device to operate in either the clockwise or counter clockwise direction allows it to be used adjacent a vertical surface where movement in only one direction is allowed.

While a preferred embodiment of the invention has been described using specific terms, such description is for illustrative purposes only, and it is to be understood that changes and variations may be made without departing from the spirit or scope of the following claims.

What is claimed is:

1. A board pushing device adopted to press unsecured boards along their entire length into contact with boards secured to support joists, said camming device comprising;

a mounting plate having an outer edge and an upper and lower surface;

a pair of spaced lugs extending downwardly from said lower surface, said lugs being spaced sufficiently to receive said support joist therebetween;

said mounting plate having a first mounting means and a second mounting means formed therein, said first and second mounting means being arranged in substantially diametrically opposed relationship adjacent said outer edge;

a camming plate having an outer edge and an upper and lower surface;

an operating lever secured with said camming plate;

said camming plate having mounting means located substantially adjacent said outer edge and oppositely of said operating lever;

a locking lever secured with said second mounting means of said mounting plate and arranged to extend vertically from said upper surface thereof;

securing means received in said first mounting means of said mounting plate and said mounting means of said camming plate to eccentrically and pivotally secure said camming plate with said mounting plate; whereby, with said mounting plate resting on one of said support joist and in position adjacent a board to be pressed, said locking lever is rotated to lock said support plate in position by camming said lugs against opposite sides of said joist, said operating lever is then rotated to drive the outer camming surface of said camming plate against the unsecured board to shift said board into contact with an outermost of said secured boards and into position to be secured with said joist.

2. The device of claim 1 wherein each of said lugs are formed with at least two inner faces arranged at 45° angles.

3. The device of claim 2 wherein said lugs are formed with opposing vertical edges.

4. The device of claim 1 wherein at least one of said support plate and said camming plate have a circular outer surface.

5. The device of claim 1 wherein said operating lever includes an operating handle arranged perpendicularly with its longitudinal axis.

6. The device of claim 1 wherein said operating lever is removably attached with said camming plate.

7. The device of claim 1 wherein said locking lever and operating lever are movable in either direction when pressing said unsecured board.

8. The device of claim 7 wherein said operating lever is moved in the direction of movement of said locking lever.

9. A camming device for forcing an unsecured member into contact with a secured member where said unsecured member may be secured with support members, said camming device comprising;

a support plate having locking means, said locking means including a pair of locking lugs and a locking lever;

a camming member having a camming surface and an operating lever;

means pivotally securing said camming member with said support plate in an eccentric fashion; whereby, in operation said camming device is positioned adjacent said unsecured member and on one of said support members with said lugs of said support plate extending along opposite sides thereof, said locking lever is actuated to lock said support plate with said support member, said operating lever is actuated to move said camming member against said unsecured member to press same into position adjacent said secured member where it is secured with said one support member.

10. The device of claim 9 wherein said camming device is made of cast aluminum.

11. The device of claim 9 wherein said lugs are formed integral with said support member along an outer edge thereof and in diametrically oppose relationship.

12. The device of claim 11 wherein each said lug comprises a first and a second inner face arranged at 45° angles relative to each other forming an edge along one side thereof.

13. The device of claim 12 wherein, with said locking device in locked position with one of said support members, only said inner edges and a first inner face of one lug and a second interface of a second lug will be in locking contact with said support member.

14. The device of claim 11 wherein said inner edges are separated by approximately 1.75" along their length.

15. The device of claim 9 wherein said device weighs no more than 4 lbs.

16. The device of claim 9 wherein said operating lever includes a handle.

* * * * *